US011394150B2

(12) United States Patent
Chang et al.

(10) Patent No.: US 11,394,150 B2
(45) Date of Patent: Jul. 19, 2022

(54) ELECTRICAL PLUG CONNECTOR

(71) Applicant: ADVANCED-CONNECTEK INC., New Taipei (TW)

(72) Inventors: Ming-Yung Chang, New Taipei (TW); Tzu-Hao Li, New Taipei (TW); Chia-Cheng He, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 22 days.

(21) Appl. No.: 17/025,657

(22) Filed: Sep. 18, 2020

(65) Prior Publication Data

US 2021/0091522 A1 Mar. 25, 2021

Related U.S. Application Data

(60) Provisional application No. 62/902,687, filed on Sep. 19, 2019.

(51) Int. Cl.

| | |
|---|---|
| ***H01R 13/424*** | (2006.01) |
| ***H01R 24/60*** | (2011.01) |
| ***H01R 13/506*** | (2006.01) |
| ***H01R 13/405*** | (2006.01) |
| ***H01R 13/26*** | (2006.01) |
| ***H01R 13/42*** | (2006.01) |
| ***H01R 13/627*** | (2006.01) |
| ***H01R 13/629*** | (2006.01) |
| ***H01R 13/6583*** | (2011.01) |
| ***H01R 13/11*** | (2006.01) |
| ***H01R 107/00*** | (2006.01) |

(52) U.S. Cl.

CPC ..... *H01R 13/424* (2013.01); *H01R 13/11* (2013.01); *H01R 13/26* (2013.01); *H01R 13/405* (2013.01); *H01R 13/42* (2013.01); *H01R 13/506* (2013.01); *H01R 13/629* (2013.01); *H01R 13/6271* (2013.01); *H01R 13/6583* (2013.01); *H01R 24/60* (2013.01); *H01R 2107/00* (2013.01)

(58) Field of Classification Search

CPC ..... H01R 13/11; H01R 13/26; H01R 13/405; H01R 13/42; H01R 13/424; H01R 13/506; H01R 13/6271; H01R 13/629; H01R 13/6583; H01R 24/60; H01R 2107/00

See application file for complete search history.

(56) References Cited

U.S. PATENT DOCUMENTS

| | | | | |
|---|---|---|---|---|
| 9,368,927 | B2 * | 6/2016 | Kawamura | H01R 24/60 |
| 9,685,739 | B2 * | 6/2017 | Chen | H01R 24/60 |
| 2013/0344739 | A1 * | 12/2013 | Shih | H01R 13/658 439/607.28 |
| 2015/0357771 | A1 * | 12/2015 | Chen | H01R 43/20 439/607.01 |
| 2018/0151985 | A1 * | 5/2018 | Zhang | H01R 13/6585 |

* cited by examiner

*Primary Examiner* — Oscar C Jimenez

(74) *Attorney, Agent, or Firm* — Muncy, Geissler, Olds & Lowe, P.C.

(57) ABSTRACT

An electrical plug connector includes a metallic shell, a first insulated housing in the metallic shell, and a second insulated housing in the metallic shell. The first tail portions of the first terminals are divided into a first tail group and a second tail group. The second insulated housing and the first insulated housing are combined with each other. Each of the second terminals includes a second tail portion between the first tail group and the second tail group. The second tail portions and the first tail portions are aligned at a same horizontal height.

15 Claims, 13 Drawing Sheets

ELECTRICAL PLUG CONNECTOR

CROSS-REFERENCE TO RELATED APPLICATION

This non-provisional application claims priority under 35 U.S.C. § 119(e) to U.S. Provisional Patent Application No. 62/902,687, filed on Sep. 19, 2019, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a USB type-C electrical connector known to the inventor(s) are totally different from those of a USB electrical connector known to the inventor(s). A USB type-C electrical receptacle connector known to the inventor(s) includes a one-piece primary plastic core, upper-row plug terminals and lower-row plug terminals held on the primary plastic core, secondary plastic cores respectively assembled with the upper-row plug terminals and the lower-row plug terminals, a hook member between the upper-row plug terminals and the lower-row plug terminals, an outer iron shell circularly enclosing the primary plastic core and the secondary plastic cores, and conductive pieces on the primary plastic core and the secondary plastic cores.

SUMMARY OF THE INVENTION

In general, the assembling procedure for a USB type-C electrical plug connector known to the inventor(s) is, the upper-row plug terminals, the lower-row plug terminals, and the hook member are stacked with each other, and then the assembly is positioned using the positioning holes and posts on the upper secondary plastic core and the lower secondary plastic core, respectively. The upper-row plug terminals, the lower-row plug terminals and the hook member are assembled as one assembly, and then the assembly is further assembled with the primary plastic core to form a two-part component. Moreover, the upper-row plug terminals and the lower-row plug terminals are assembled with the primary plastic core from the rear portion of the primary plastic core, so that the upper-row plug terminals and the lower-row plug terminals are inserted into the primary plastic core. For the USB type-C electrical plug connector known to the inventor(s), the assembling components have many types, and the assembling components are assembled with each other to form the connector through complicated assembling steps. As a result, the assembly for the connector is time-consuming and defect products would be produced easily.

In a USB type-C electrical plug connector, the pin assignment in the insertion window of the insertion side at the front portion of the connector is of a full-pin configuration, the flexible contact portions of twelve upper-row plug terminals are disposed at the upper row of the insertion window (as the pin assignments from A01 to A12 shown in the table below), and the flexible contact portions of ten lower-row plug terminals are disposed at the lower row of the insertion window (as the pin assignments from B01 to B12 (exclude B06 and B07) shown in the table below). The plug terminals are arranged into an upper row and a lower row at the soldering side at the rear portion of the connector for soldering with contacts on the upper surface and the lower surface of the circuit board.

| A12 | A11 | A10 | A09 | A08 | A07 | A06 | A05 | A04 | A03 | A02 | A01 |
|---|---|---|---|---|---|---|---|---|---|---|---|
| GND | RX2+ | RX2− | VBUS | SBU1 | D− | D+ | CC | VBUS | TX1− | TX1+ | GND |
| GND | TX2+ | TX2− | VBUS | VCONN | | | SBU2 | VBUS | RX1− | RX1+ | GND |
| B01 | B02 | B03 | B04 | B05 | B06 | B07 | B08 | B09 | B10 | B11 | B12 |

In view of these, according to one or some embodiments of the instant disclosure, an electrical plug connector is provided. The electrical plug connector comprises a metallic shell, a first main body, and a second main body. The metallic shell comprises a receiving cavity. The first main body comprises a first insulated housing and a plurality of first terminals combined with the first insulated housing. Each of the first terminals comprises a first tail portion extending out of an end portion of the first insulated housing. The first tail portions are divided into a first tail group formed by some of the first tail portions and a second tail group formed by the rest of the first tail portions. The second main body comprises a second insulated housing and a plurality of second terminals combined with the second insulated housing. The first insulated housing and the second insulated housing are combined with each other and received in the receiving cavity. Each of the second terminals comprises a second tail portion extending out of an end portion of the second insulated housing. The second tail portions are between the first tail group and the second tail group. The second tail portions and the first tail portions are aligned at a same horizontal height.

In one or some embodiments, a pin assignment of the first tail portions of the first terminals, from right to left, is a rightmost first ground terminal, a pair of first high-speed signal terminals, a first power terminal, a first function detection terminal, a pair of first low-speed signal terminals, and a leftmost first ground terminal. An arrangement space for arranging the second tail portions is between the first power terminal and the first function detection terminal.

In one or some embodiments, the first terminals comprise a plurality of first horizontal bent portions. The first horizontal bent portions are formed at the first function detection terminal and the pair of the first low-speed signal terminals.

In one or some embodiments, a pin assignment of the second tail portions of the second terminals, from right to left, is a second ground terminal, a pair of second high-speed signal terminals, and a second power terminal. The second ground terminal is adjacent to the first power terminal, and the second power terminal is adjacent to the first function detection terminal.

In one or some embodiments, the second terminals comprise a plurality of second horizontal bent portions. The second horizontal bent portions are formed at the second ground terminal, the pair of the second high-speed signal terminals, and the second power terminal.

In one or some embodiments, each of the first terminals comprises a first flexible contact portion arranged at a first row, and each of the second terminals comprises a second flexible contact portion arranged at a second row. From right to left of the second terminals, the second flexible contact portion of the second ground terminal, the second flexible contact portion of each of the pair of the second high-speed signal terminals, and the second flexible contact portion of the second power terminal correspond to, from right to left of the first terminals, the first flexible contact portion of the rightmost first ground terminal, the first flexible contact portion of each of the pair of the first high-speed signal terminals, and the first flexible contact portion of the first power terminal, respectively.

In one or some embodiments, the first tail portions and the second tail portions are portions manufactured by surface mount technology (SMT).

In one or some embodiments, the first terminals comprise a plurality of first vertical bent portions, and the first vertical bent portions are formed adjacent to the first tail portions, respectively.

In one or some embodiments, the second terminals comprise a plurality of second vertical bent portions, and the second vertical bent portions are formed adjacent to the second tail portions, respectively.

In one or some embodiments, the electrical plug connector further comprises a first terminal module and a second terminal module. The first terminal module comprises the first terminals and a first assembling block. The second terminal module comprises the second terminals and a second assembling block. The first insulated housing comprises a first inner assembling space, and the second insulated housing comprises a second inner assembling space. The first assembling block is retained in the first inner assembling space of the first insulated housing, and the second assembling block is retained in the second inner assembling space of the second insulated housing.

In one or some embodiments, the first assembling block comprises a front portion and a rear portion. The front portion of the first assembling block is retained in the first inner assembling space of the first insulated housing and the rear portion of the first assembling block is behind the first insulated housing.

In one or some embodiments, the second assembling block comprises a front portion and a rear portion. The front portion of the second assembling block is retained in the second inner assembling space of the second insulated housing and the rear portion of the second assembling block is behind the second insulated housing.

In one or some embodiments, two side latches are respectively disposed on two sides of the first main body and the second main body along a transverse direction. Each of the side latches comprises a side arm and a latch portion. The latch portion is at a front portion of the side arm and inserted into an insertion cavity of the electrical plug connector along the transverse direction.

Another embodiment of the instant disclosure provides an electrical plug connector. The electrical plug connector comprises a metallic shell, a first main body, and a second main body. The metallic shell comprises a receiving cavity. The first main body comprises a first insulated housing and a first terminal module which comprises a plurality of first terminals and a first assembling block. The first terminal module is combined with the first insulated housing. Each of the first terminals comprises a first tail portion extending out of an end portion of the first insulated housing. The first tail portions are divided into a first tail group formed by some of the first tail portions and a second tail group formed by the rest of the first tail portions. The second main body comprises a second insulated housing and a second terminal module which comprises a plurality of second terminals and a second assembling block. The second terminal module is combined with the second insulated housing. The first insulated housing and the second insulated housing are combined with each other and received in the receiving cavity. Each of the second terminals comprises a second tail portion extending out of an end portion of the second insulated housing. The second tail portions and the first tail portions are aligned at a same horizontal height.

In one or some embodiments, the first insulated housing comprises a first inner assembling space and the second insulated housing comprises a second inner assembling space. The first assembling block is retained in the first inner assembling space of the first insulated housing, and the second assembling block is retained in the second inner assembling space of the second insulated housing.

According to one or some embodiments of the instant disclosure, the first terminal module comprises the first terminals and the first assembling block combined with each other to form a one-piece member by injection molding, and then the first insulated housing is further combined with the first terminal module; likewise, the second terminal module comprises the second terminals and the second assembling block combined with each other to form a one-piece member by injection molding, and then the second insulated housing is further combined with the second terminal module. The four-piece component is assembled into the metallic shell. Accordingly, the number of the components for manufacturing the connector can be reduced, thereby simplifying the assembling procedure for the connector. Moreover, the second tail portions are between the first tail group of the first tail portions and the second tail group of the first tail portions. The second tail portions and the first tail portions are aligned at a same horizontal height and are portions manufactured by surface mount technology (SMT).

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
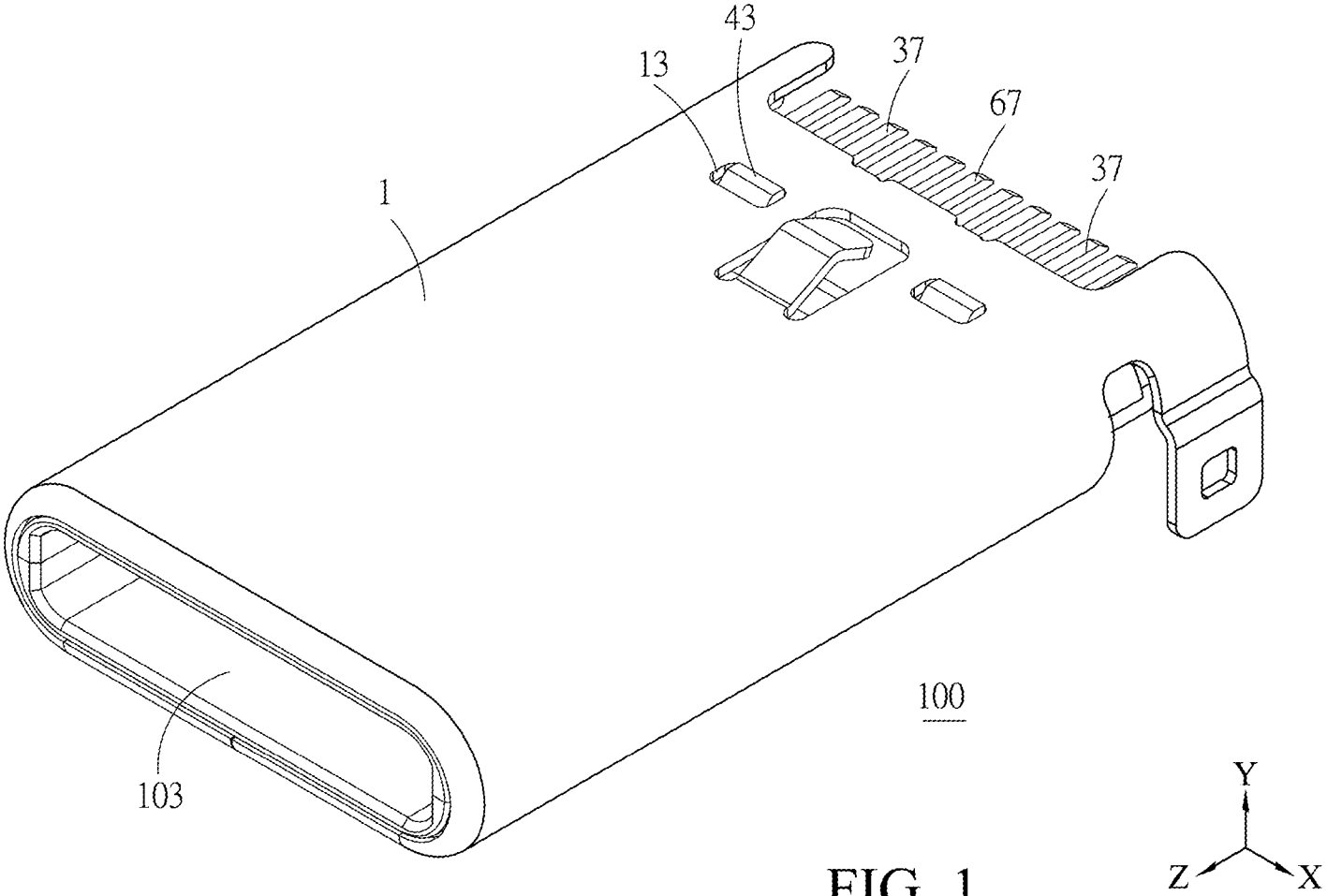
FIG. 1 illustrates a front perspective view of an electrical plug connector according to a first embodiment of the instant disclosure.
Figure 2:
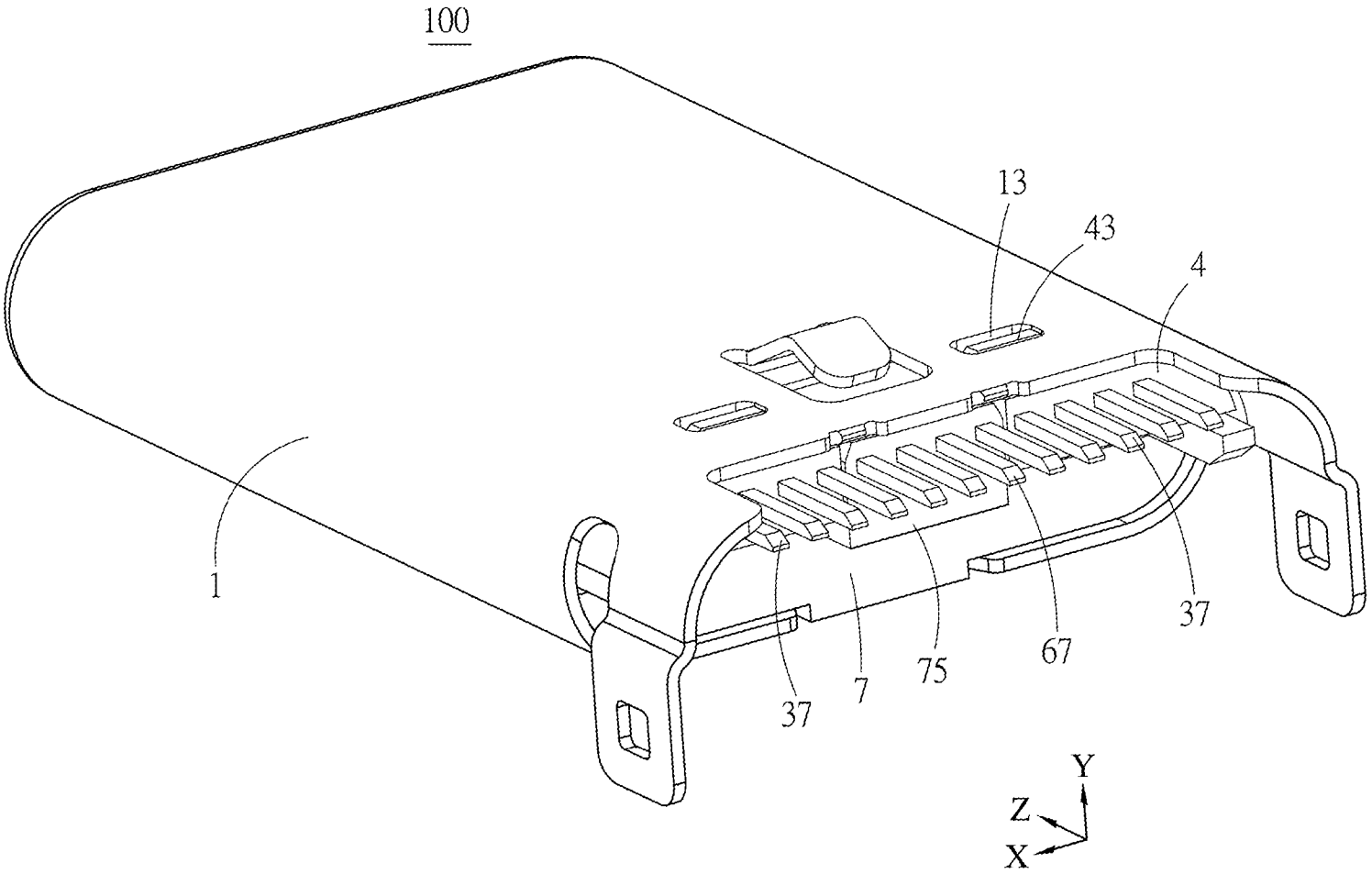
FIG. 2 illustrates a rear perspective view of the electrical plug connector of the first embodiment.
Figure 3:
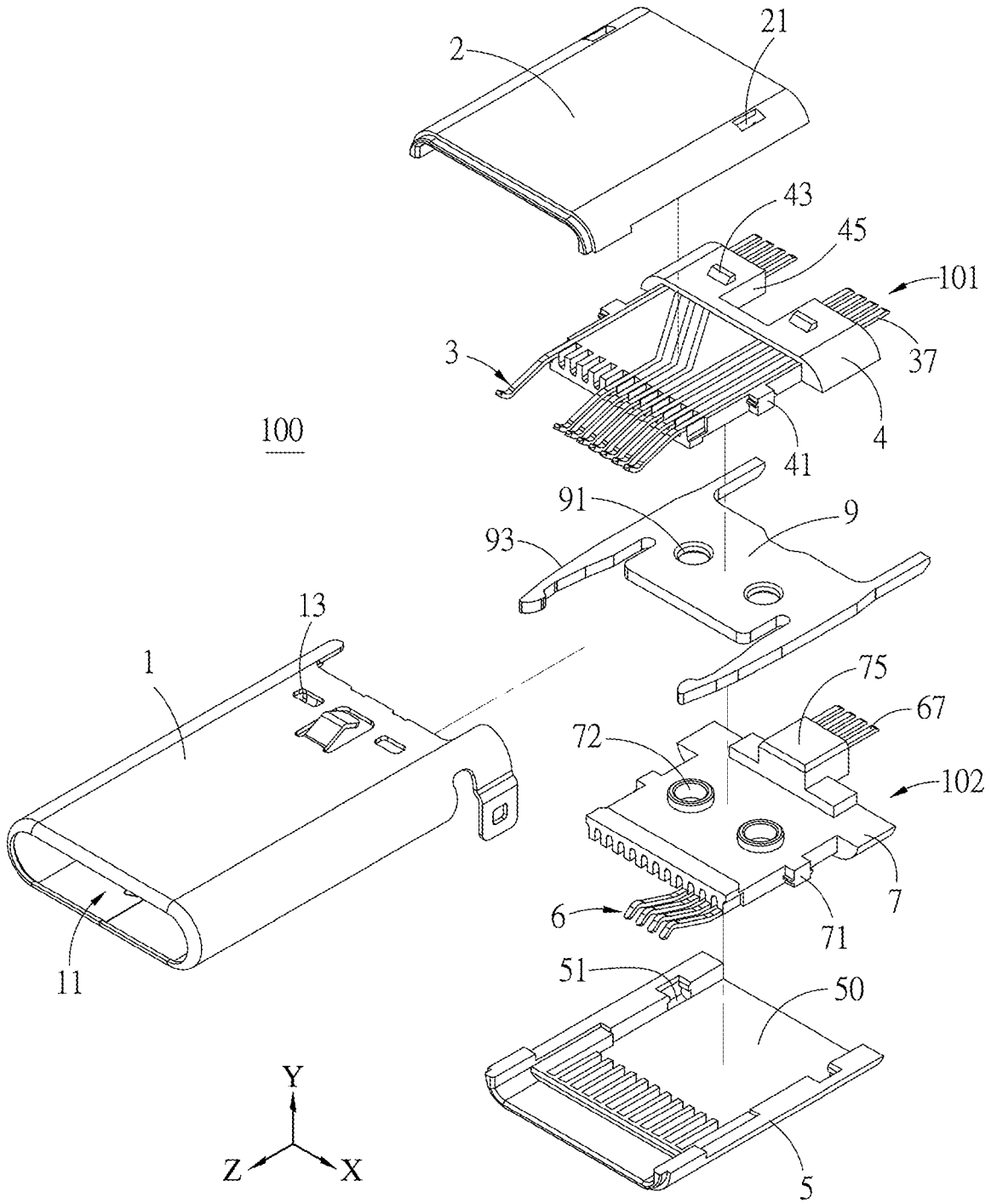
FIG. 3 illustrates a front exploded view of the electrical plug connector, where the first terminals and the first assembling block of the first terminal module are not exploded and the second terminals and the second assembling block of the second terminal module are not exploded.

Please refer to FIGS. 1 to 3. An electrical plug connector 100 according to a first embodiment of the instant disclosure is illustrated. FIGS. 1 and 2 respectively illustrate front and rear perspective views of the electrical plug connector 100 of the first embodiment. FIG. 3 illustrates a front exploded view of the electrical plug connector 100, where the first terminals 3 and the first assembling block 4 of the first terminal module 101 are not exploded and the second terminals 6 and the second assembling block 7 of the second terminal module 102 are not exploded. In this embodiment, the electrical plug connector 100 can provide a reversible or dual orientation USB Type-C connector interface or pin assignments, i.e., a USB Type-C plug connector, but embodiments are not limited thereto. The electrical plug connector 100 comprises a metallic shell 1, a first main body, and a second main body. The first main body comprises a first insulated housing 2 and a plurality of first terminals 3, and the second main body comprises a second insulated housing 5 and a plurality of second terminals 6. In some embodiments, the first terminal module 101 comprises the first terminals 3 and a first assembling block 4. In some embodiments, the second terminal module 102 comprises the second terminals 6 and a second assembling block 7.

Please refer to FIGS. 1 to 3. In some embodiments, the metallic shell 1 comprises a receiving cavity 11, and the metallic shell 1 encloses the first insulated housing 2 and the second insulated housing 5. In other words, the first insulated housing 2 and the second insulated housing 5 are assembled with each other and received in the receiving cavity 11 along a longitudinal direction (i.e. a rear-to-front direction or a front-to-rear direction). The metallic shell 1 is a hollowed shell formed by deep drawing techniques. In other words, the metallic shell 1 is a unitary element and is a seamless shell. The metallic shell 1 has a beautiful appearance and improved structural strength. In this embodiment, the metallic shell 1 is a unitary member, but embodiments are not limited thereto. In some embodiments, several pieces may be bent to form the metallic shell 1. Moreover, the upper inner side and the lower inner side of the rear portion of the metallic shell 1 are bent to form buckling holes 13. The buckling holes 13 are respectively buckled with corresponding protrusion portions 43 of the first assembling block 4 of the first terminal module 101 and corresponding protrusion portions 73 of the second assembling block 7 of the second terminal module 102 (as shown in FIG. 4).

Figure 4:
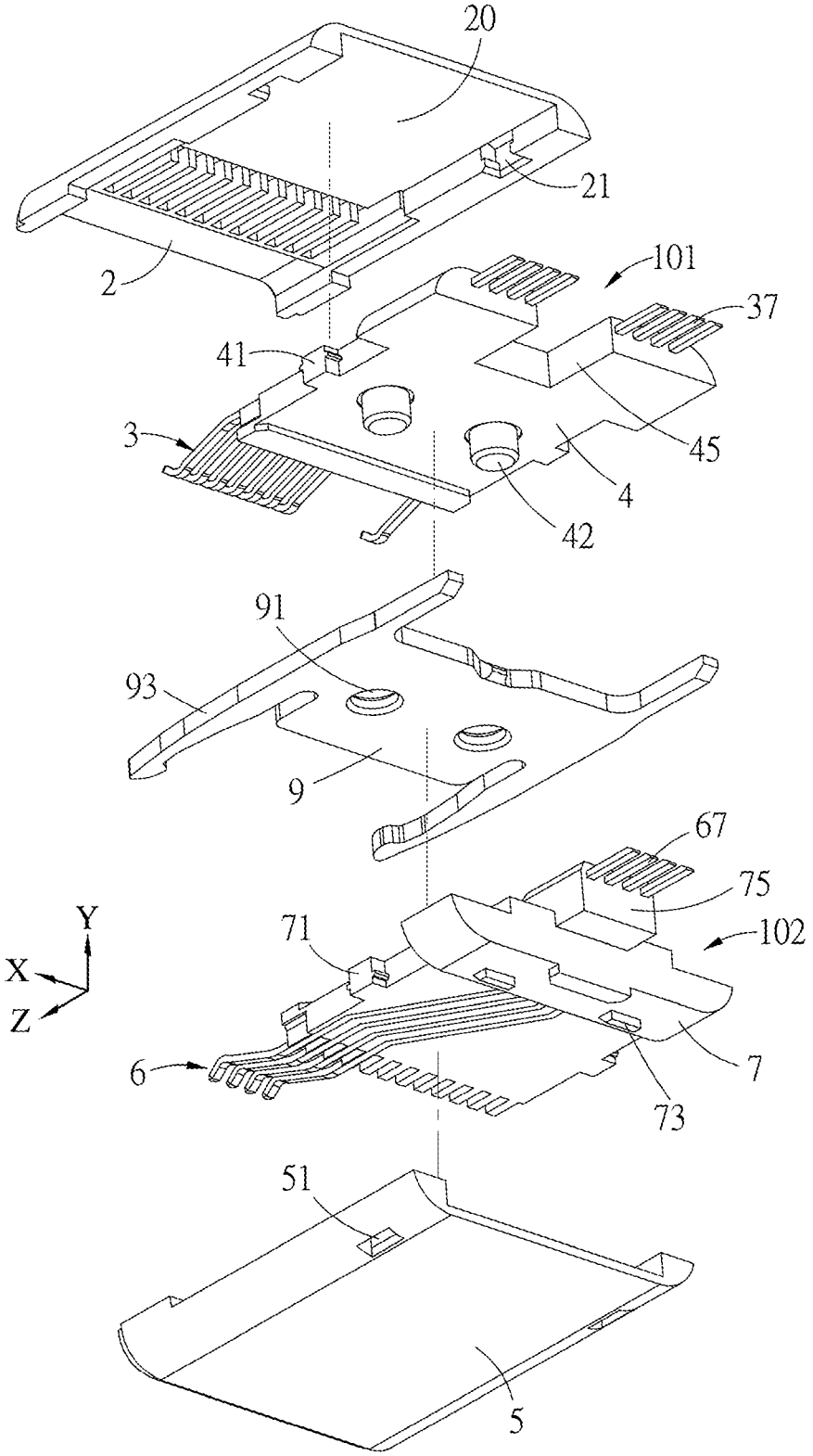
FIG. 4 illustrates a rear exploded view of the electrical plug connector, where the first terminals and the first assembling block of the first terminal module are not exploded and the second terminals and the second assembling block of the second terminal module are not exploded, and the metallic shell is not shown.

Please refer to FIGS. 3 and 4. FIG. 4 illustrates a rear exploded view of the electrical plug connector 100, where the first terminals 3 and the first assembling block 4 of the first terminal module 101 are not exploded and the second terminals 6 and the second assembling block 7 of the second terminal module 102 are not exploded, and the metallic shell 1 is not shown. In some embodiments, the first insulated housing 2 comprises a first inner assembling space 20 along a vertical direction, and the second insulated housing 5 comprises a second inner assembling space 50 along the vertical direction.

Please refer to FIGS. 3 and 4. In some embodiments, the first terminal module 101 comprises a plurality of first terminals 3 and a first assembling block 4. The first assembling block 4 is molded with the first terminals 3 to form a first terminal module 101 and then the first assembling block 4 is received and retained in the first inner assembling space 20 of the first insulated housing 2 along the vertical direction (e.g., the inner surface of the first insulated housing 2). Alternatively, the first terminals 3 are assembled to the first assembling block 4 to form the first terminal module 101 and then the first assembling block 4 is received and retained in the first inner assembling space 20 of the first insulated housing 2 along the vertical direction.

Furthermore, the first assembling block 4 includes a front portion and a rear portion. Each of the first terminals 3 includes a first flexible contact portion 35, a first body portion 36, and a first tail portion 37. The first flexible contact portions 35 of the first terminals 3 protrude out the front portion of the first assembling block 4 along a rear-to-front direction. The first body portions 36 of the first terminals 3 are retained in the first assembling block 4. The first tail portions 37 of the first terminals 3 protrude out the rear portion of the first assembling block 4 along a front-to-rear direction. In this embodiment, when the first terminal module 101 is assembled with the first insulated housing 2 along the vertical direction, the front portion of the first assembling block 4 is received and retained in the first inner assembling space 20 of the first insulated housing 2 along the vertical direction and the rear portion of the first assembling block 4 is behind the first insulated housing 2 along the front-to-rear direction. However, embodiments are not limited thereto.

Please refer to FIGS. 3 and 4. In some embodiments, the second terminal module 102 comprises a plurality of second terminals 6 and a second assembling block 7. The second assembling block 7 is molded with the second terminals 6 to form a second terminal module 102 and then the second assembling block 7 is received and retained in the second inner assembling space 50 of the second insulated housing 5 along the vertical direction (e.g., the inner surface of the second insulated housing 5). Alternatively, the second terminals 6 are assembled to the second assembling block 7 to form a second terminal module 102 and then the second assembling block 7 is received and retained in the second inner assembling space 50 of the second insulated housing 5 along the vertical direction.

Furthermore, the second assembling block 7 includes a front portion and a rear portion. Each of the second terminals 6 includes a second flexible contact portion 65, a second body portion 66, and a second tail portion 67. The second flexible contact portions 65 of the second terminals 6 protrude out the front portion of the second assembling block 7 along a rear-to-front direction. The second body portions 66 of the second terminals 6 are retained in the second assembling block 7. The second tail portions 67 of the second terminals 6 protrude out the rear portion of the second assembling block 7 along a front-to-rear direction. In this embodiment, when the second terminal module 102 is assembled with the second insulated housing 5 along the vertical direction, the front portion of the second assembling block 7 is received and retained in the second inner assembling space 50 of the second insulated housing 5 along the vertical direction and the rear portion of the second assembling block 7 is behind the second insulated housing 5 along the front-to-rear direction. However, embodiments are not limited thereto.

Figure 6:
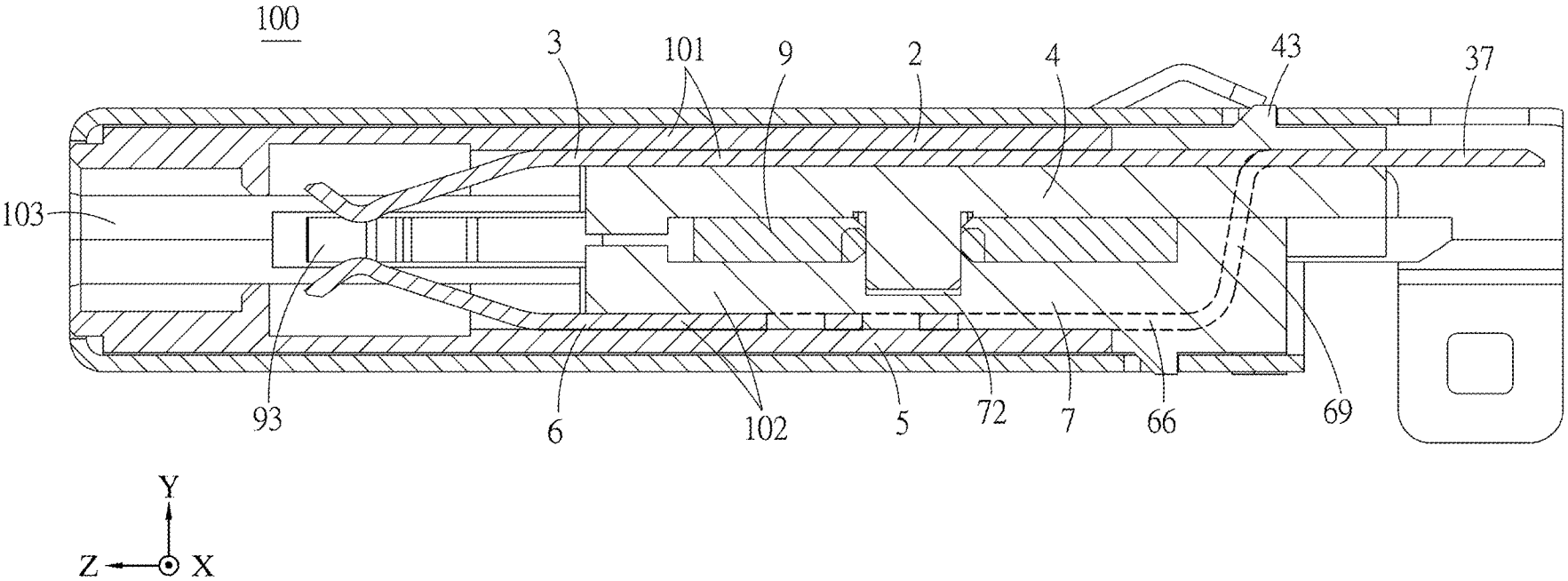
FIG. 6 illustrates a side sectional view of the electrical plug connector of the first embodiment, where the dash line illustrates the second body portion of the electrical plug connector.

Please refer to FIGS. 3, 4, and 6. FIG. 6 illustrates a side sectional view of the electrical plug connector of the first embodiment. In some embodiments, the first terminal module 101, the second terminal module 102, the first insulated housing 2, and the second insulated housing 5 are assembled with each other along the vertical direction to form a four-piece assembly, and an insertion cavity 103 is formed along the longitudinal direction and is between an inner side of the assembly of the first insulated housing 2 and the second insulated housing 5. The first insulated housing 2, the second insulated housing 5, the first terminal module 101, and the second terminal module 102 are received in the receiving cavity 11 of the metallic shell 1. In this embodiment, the first insulated housing 2 and the second insulated housing 5 have shortened lengths. The longitudinal direction is perpendicular to the vertical direction.

The first insulated housing 2 assembled with the first terminal module 101 along the vertical direction and the second insulated housing 5 assembled with the second terminal module 102 along the vertical direction are combined with each other and together received in the receiving cavity 11 of the metallic shell 1.

Please refer to FIGS. 3, 4, and 6. In some embodiments, the first insulated housing 2 is combined with the first terminals 3. Each of the first terminals 3 comprises a first tail portion 37 extending out of an end portion of the first insulated housing 2 (as shown in FIG. 2). The first tail portions 37 are divided into a first tail group 371 by some of the first tail portions 37 and a second tail group 372 formed by the rest of the first tail portions 37. For example, the number of the first tail portions 37 in the first tail group 371 may be, but not limited to, four; similarly, the number of the first tail portions 37 in the second tail group 372 may be, but not limited to, four.

Figure 5:
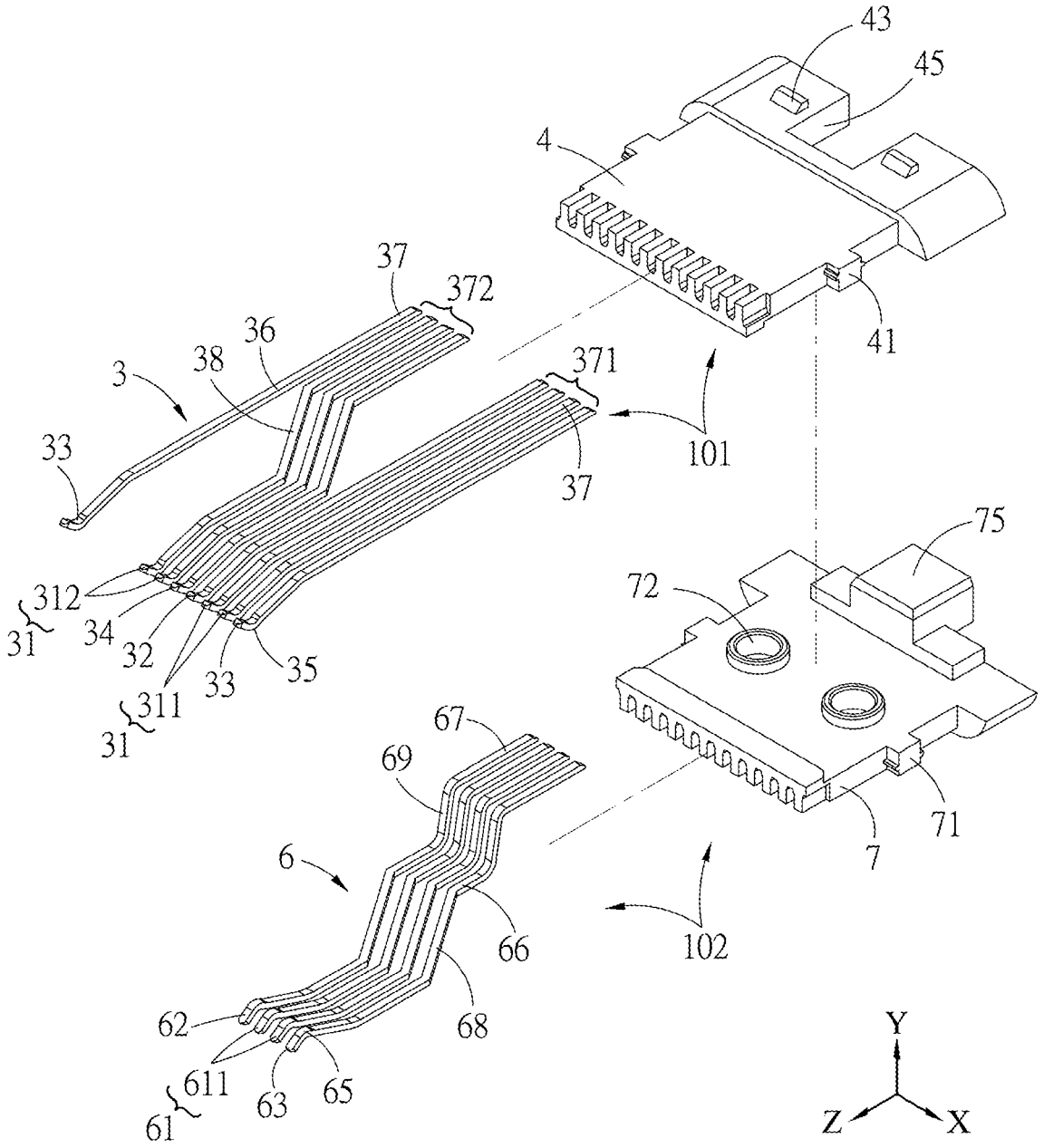
FIG. 5 illustrates a front exploded view of the electrical plug connector, where the first terminals and the first assembling block of the first terminal module are exploded and the second terminals and the second assembling block of the second terminal module are exploded.

Please refer to FIGS. 3 to 6. FIG. 5 illustrates a front exploded view of the electrical plug connector 100 of the first embodiment, where the first terminals 3 and the first assembling block 4 of the first terminal module 101 are exploded and the second terminals 6 and the second assembling block 7 of the second terminal module 102 are exploded. In some embodiments, the second assembling block 5 and the first assembling block 2 are combined with each other and received in the receiving cavity 11. The second insulated housing 5 is combined with the second terminals 6. Each of the second terminals 6 comprises a second tail portion 67 extending out of an end portion of the second insulated housing 5 (as shown in FIG. 2). The second tail portions 67 are between the first tail group 371 and the second tail group 372. The second tail portions 67 and the first tail portions 37 are aligned at a same horizontal height. As shown in FIG. 2, the first tail portions 37 and the second tail portions 67 are aligned at a horizontal height in the X axis direction.

Please refer to FIGS. 3, 5, and 6. In some embodiments, the first terminal module 101 comprises the first terminals 3 and the first assembling block 4 combined with each other to form a one-piece member by injection molding (or by insert-molding), thereby forming the first part, and then the first part is further combined with the first insulated housing 2 (the second part). Likewise, the second terminal module 102 comprises the second terminals 6 and the second assembling block 7 combined with each other to form a one-piece member by injection molding (or by insert-molding), thereby forming the third part, and then the third part is further combined with the second insulated housing 5 (the fourth part).

Please refer to FIGS. 3, 5, and 6. In some embodiments, the first terminals 3 and the first assembling block 4 are closely combined with each other, thereby preventing moist from entering into the electrical plug connector 100 from the insertion side at the front portion of the electrical plug connector 100 (as the insertion cavity 103 of the connector shown in FIG. 8), flowing through the contact portions between the first terminals 3 and the first assembling block 4 (as the terminal groove of the first assembling block 4 shown in FIG. 6), and flowing into the soldering side at the rear portion of the electrical plug connector 100 (as the first tail portions 37 and the second tail portions 67 of the connector shown in FIG. 2).

Please refer to FIGS. 3, 5, and 6. In some embodiments, the second terminals 6 and the second assembling block 7 are closely combined with each other, thereby preventing moist from entering into the electrical plug connector 100 from the insertion side at the front portion of the electrical plug connector 100 (as the insertion cavity 103 of the connector shown in FIG. 6), flowing through the contact portions between the second terminals 6 and the second assembling block 7 (as the terminal groove of the second assembling block 7 shown in FIG. 6), and flowing into the soldering side at the rear portion of the electrical plug connector 100 (as the first tail portions 37 and the second tail portions 67 of the connector shown in FIG. 2).

Please refer to FIGS. 3, 5, and 6. In some embodiments, the four parts, that is, first terminal module 101, the second terminal module 102, the first insulated housing 2, and the second insulated housing 5 are assembled with each other, and then the assembly is assembled into the metallic shell 1. Accordingly, the assembling components are simplified as the upper component (the assembly of the first part and the second part) and the lower component (the assembly of the third part and the fourth part), and then the upper component and the lower component are assembled into the receiving cavity 11 of the metallic shell 1. Hence, the number of the components for manufacturing the connector can be reduced, thereby simplifying the assembling procedure for the connector.

Figure 7:
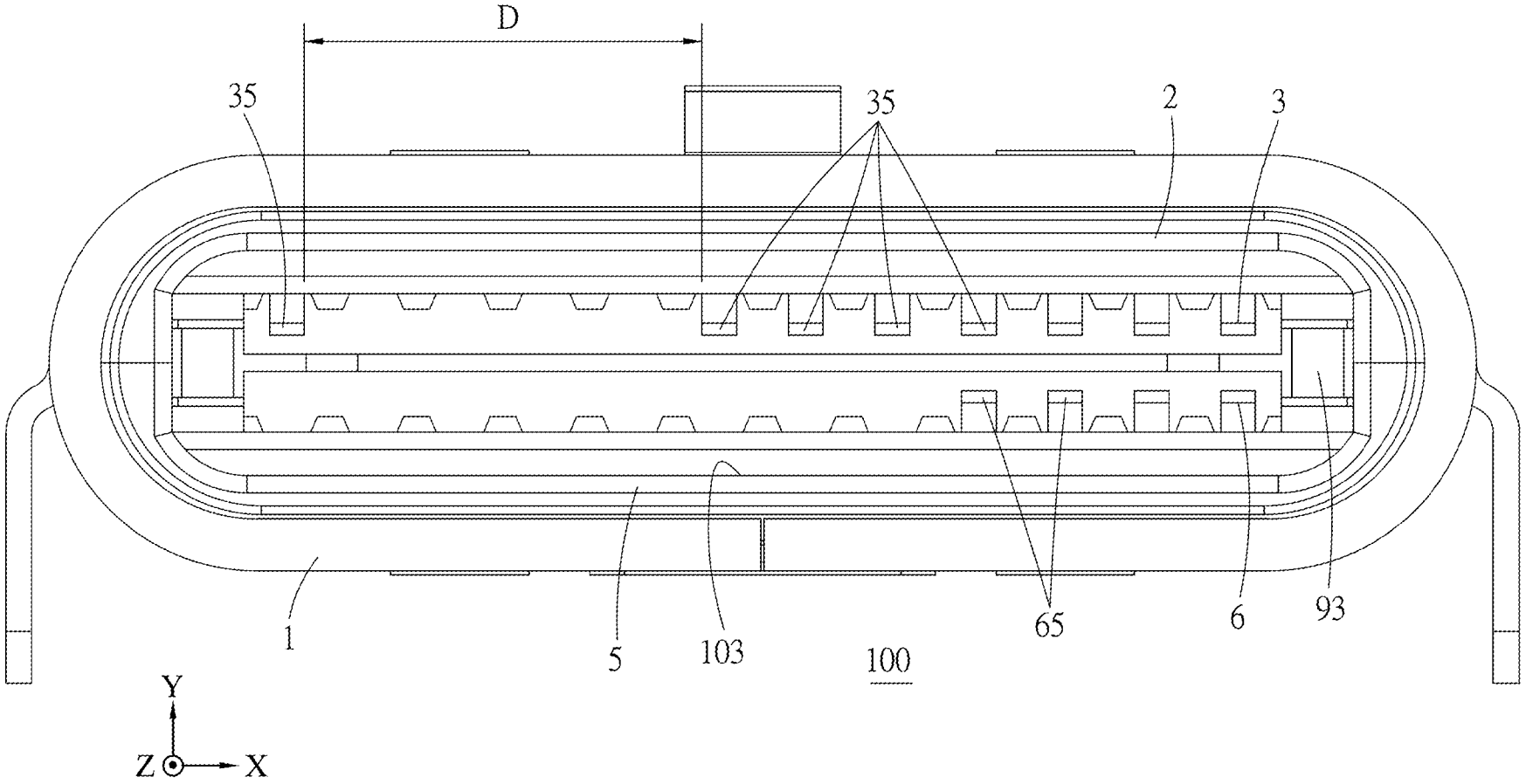
FIG. 7 illustrates a front plan view of the electrical plug connector of the first embodiment.

Please refer to FIGS. 3, 6, and 7. FIG. 7 illustrates a front plan view of the electrical plug connector 100 of the first embodiment. In some embodiments, the first insulated housing 2 and the second insulated housing 5 are half portions of a tubular structure, respectively. In other words, in some embodiments, the first insulated housing 2 and the second insulated housing 5 each is a half-tubular elongated plate. The upper portion of the insulated housing (the first insulated housing 2 and the second insulated housing 5) is symmetrical to the lower portion of the insulated housing (the first insulated housing 2 and the second insulated housing 5), and the left portion of the insulated housing (the first insulated housing 2 and the second insulated housing 5) is symmetrical to the right portion of the insulated housing (the first insulated housing 2 and the second insulated housing 5). Moreover, the first insulated housing 2 is combined with the second insulated housing 5 to form the tubular structure, and the insertion cavity 103 (as shown in FIG. 6) is formed inside the tubular structure for mating with an electrical receptacle connector.

Please refer to FIGS. 3, 5, and 7. In some embodiments, the first terminals 3 comprise a plurality of first signal terminals 31, at least one power terminal 32, and at least one ground terminal 33. From a front view of the first terminals 3 shown in FIG. 7, the first terminals 3 comprise, from right to left, a ground terminal 33 (Gnd), a pair of signal terminals 31 (TX1+−, first high-speed differential signal terminals 311), a power terminal 32 (Power/VBUS), a first function detection terminal (CC, a terminal for inserting orientation detection of the connector and for cable recognition), a pair of signal terminals 31 (D+−, low-speed differential signal terminals 312), and another ground terminal 33 (Gnd). The pin assignment of the first terminals 3 from A01 to A12 (exclude A08, A09, A10, and A11) is shown in the table below.

Please refer to FIGS. 3, 5, and 7. In some embodiments, each of the first terminals 3 is a bent-type terminal. Each of the first terminals 3 comprises a first flexible contact portion 35, a first body portion 36, and a first tail portion 37. In this embodiment, the first body portions 36 are held in the first assembling block 4. The first flexible contact portion 35 extends forward from the first body portion 36 in the rear-to-front direction, and the first tail portion 37 extends backward from the first body portion 36 in the front-to-rear direction and protrudes out of the first assembling block 4. The first flexible contact portion 35 has a curved profile. The first signal terminals 31 extend into the insertion cavity 103 and are provided for transmitting first signals (i.e., USB 3.0 signals or other signals (for example, but not limited to, HDMI signals)). It is understood that, in some embodiments, the number of the first terminals 3 may be reduced for USB 2.0 signal transmission.

Please refer to FIGS. 3, 5, and 7. In some embodiments, the second terminals 6 comprise a plurality of signal terminals 61, at least one power terminal 62, and at least one ground terminal 63. From a front view of the second terminals 6 shown in FIG. 7, the second terminals 6 comprise, from right to left, a ground terminal 63 (Gnd), a first pair of signal terminals 61 (TX2+−, second high-speed differential signal terminals 611), and a power terminal 62 (Power/VBUS). The pin assignment of the second terminals 6 from B09 to B12 is shown in the table above.

Please refer to FIGS. 3, 5, and 8 as well as the table below. In some embodiments, the pin assignment of the first tail portions 37 of the first terminals 3, from right to left, is a rightmost first ground terminal 33 (A01), a pair of first high-speed signal terminals 311 (A02, A03), a first power terminal 32 (A04), a first function detection terminal 34 (A09), a pair of first low-speed signal terminals 312 (A10, A11), and a leftmost first ground terminal 33 (A12). An arrangement space for arranging the second tail portions 37 is between the first power terminal 32 and the first function detection terminal 34.

Please refer to FIGS. 3, 5, and 8 as well as the table below. In some embodiments, the pin assignment of the second tail portions 67 of the second terminals 6, from right to left, is a second ground terminal 63 (B12), a pair of second high-speed signal terminals 611 (B10, B11), and a second power terminal 62 (B09). The second ground terminal 63 (B12) is adjacent to the first power terminal 32 (A04), and the second power terminal 62 (B09) is adjacent to the first function detection terminal 34 (A09).

| A12 | A11 | A10 | A09 | A08 | A07 | A06 | A05 | A04 | A03 | A02 | A01 |
|---|---|---|---|---|---|---|---|---|---|---|---|
| GND | | | | | D− | D+ | CC | VBUS | TX− | TX+ | GND |
| | | | | | | | | VBUS | RX− | RX+ | GND |
| B01 | B02 | B03 | B04 | B05 | B06 | B07 | B08 | B09 | B10 | B11 | B12 |

| A12 | A11 | A10 | A09 | B09 | B10 | B11 | B12 | A04 | A03 | A02 | A01 |
|---|---|---|---|---|---|---|---|---|---|---|---|
| GND | D− | D+ | CC | VBUS | RX− | RX+ | GND | VBUS | TX− | TX+ | GND |

Please refer to FIGS. 3, 5, and 7. In some embodiments, from a front view of the first terminals 3 and the second terminals 6, in a one-to-one manner, the second flexible contact portion 65 of the second ground terminal 63, the second flexible contact portion 65 of the second power terminal 62, and the second flexible contact portion 65 of each of the pair of the second high-speed signal terminals 611 correspond to the first flexible contact portion 35 of the rightmost first ground terminal 33, the first flexible contact portion 35 of the first power terminal 32, and the first flexible contact portion 35 of each of the pair of the first high-speed signal terminals 311. The first flexible contact portions 35 are arranged in the first row (the upper row), and the second flexible contact portions 65 are arranged in the second row (the lower row). In other words, the second flexible contact portion 65 of the second ground terminal 63, the second flexible contact portion 65 of each of the pair of the second high-speed signal terminals 611, and the second flexible contact portion 65 of the second power terminal 62 correspond to the first flexible contact portion 35 of the rightmost first ground terminal 33, the first flexible contact portion 35 of each of the pair of the first high-speed signal terminals 311, and the first flexible contact portion 35 of the first power terminal 32, respectively.

Please refer to FIGS. 3, 5, and 7. In some embodiments, each of the second terminals 6 is a bent-type terminal. Each of the second terminals 6 comprises a second flexible contact portion 65, a second body portion 66, and a second tail portion 67. In this embodiment, the second body portions 66 are held in the second assembling block 7. The second flexible contact portion 65 extends forward from the second body portion 66 in the rear-to-front direction, and the second tail portion 67 extends backward from the second body portion 66 in the front-to-rear direction and protrudes out of the second assembling block 7. The second flexible contact portion 65 has a curved profile, and the second flexible contact portions 65 correspond to the first flexible contact portions 35. In other words, for example, the first flexible contact portion 35 may be curved inward but the corresponding second flexible contact portion 65 may be curved outward. Each of the first tail portions 37 and the corresponding second tail portion 67 form a clamp for holding and contacting a circuit board. Moreover, the second terminals 6 are provided for transmitting second signals (i.e., USB 3.0 signals or other signals (for example, but not limited to, HDMI signals)). It is understood that, in some embodiments, the number of the second terminals 6 may be reduced for USB 2.0 signal transmission. In some embodiments, the first tail portions 37 and the second tail portions 67 are portions manufactured by surface mount technology (SMT).

Figure 8:
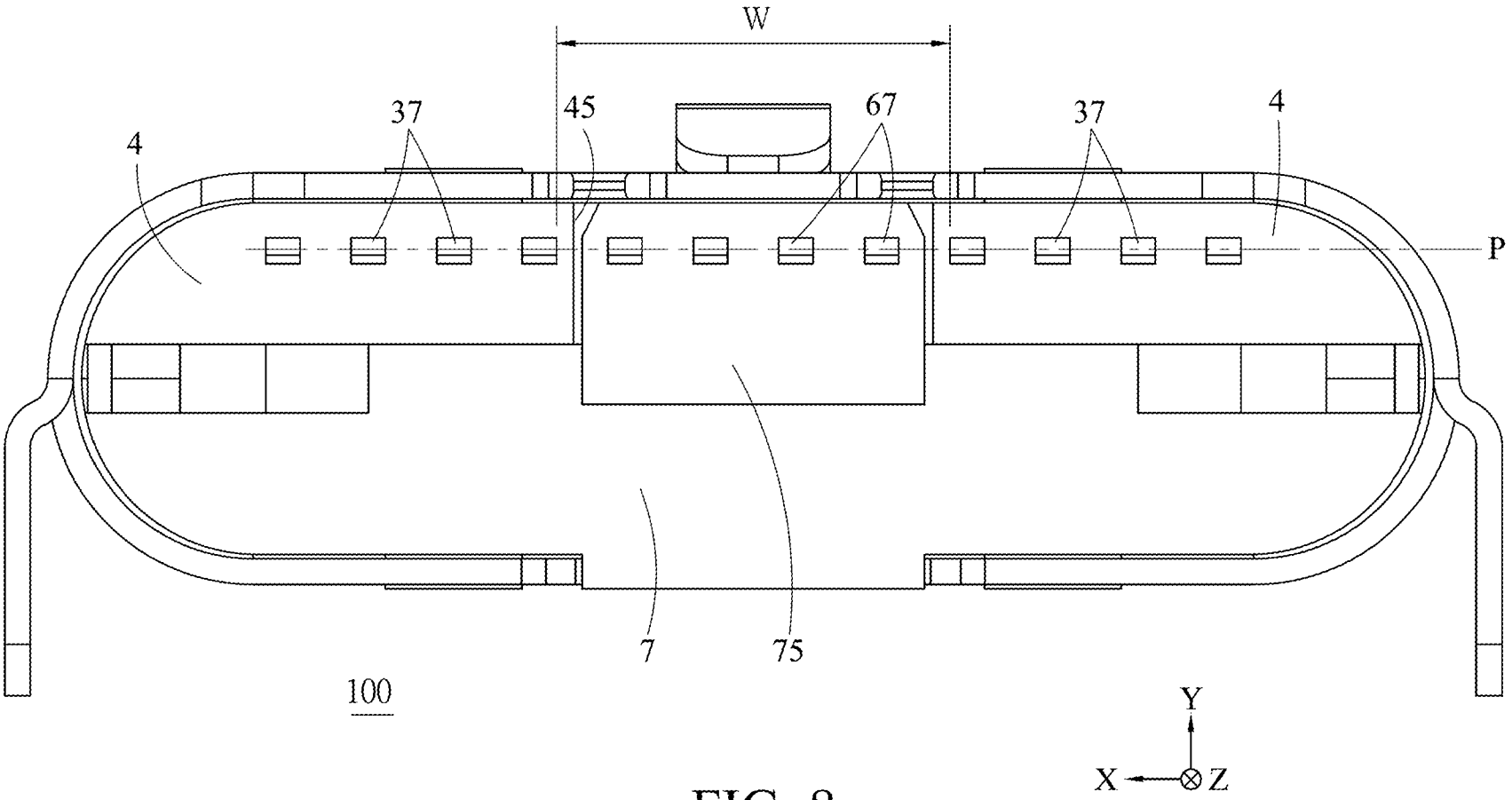
FIG. 8 illustrates a rear plan view of the electrical plug connector of the first embodiment.
Figure 10:
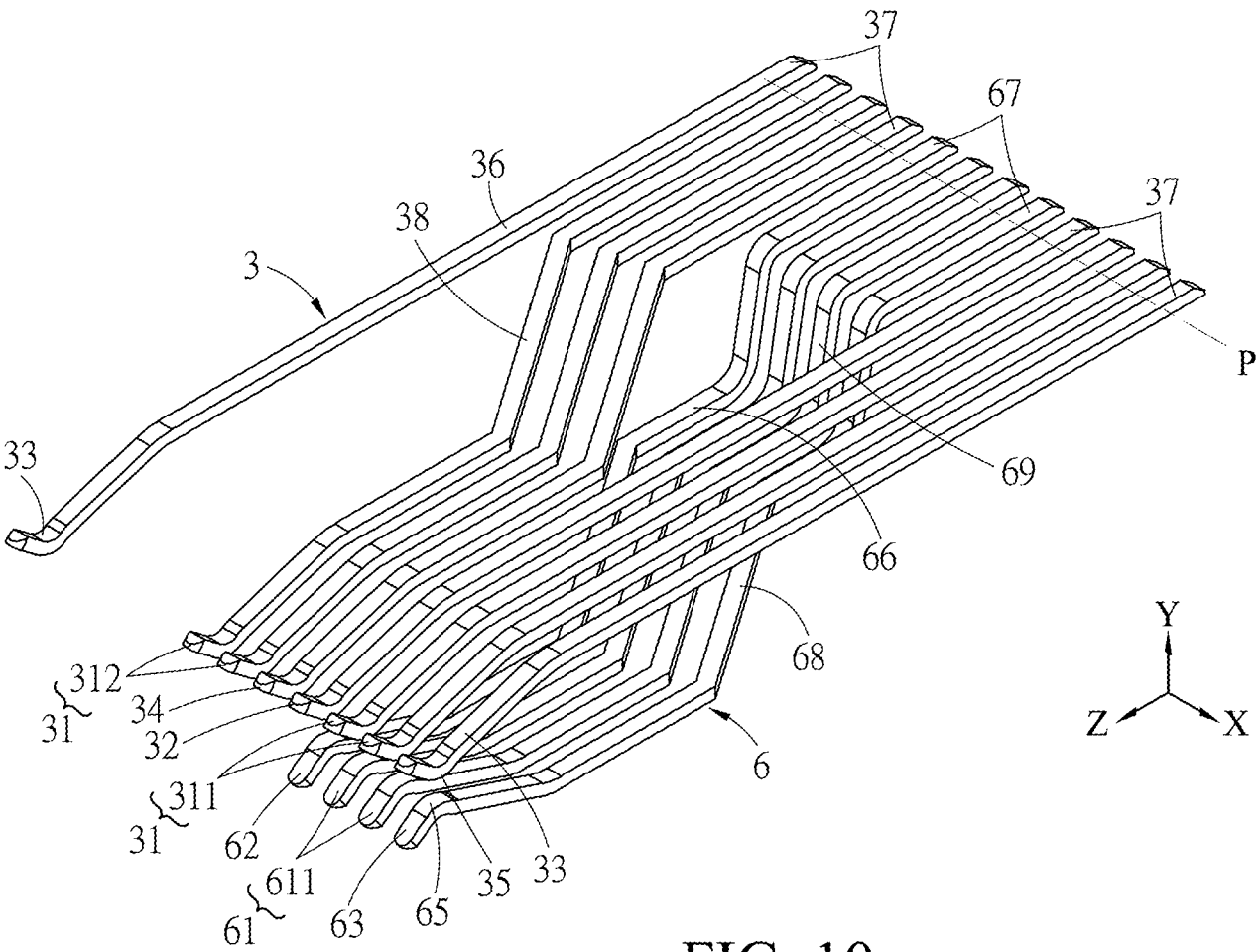
FIG. 10 illustrates a schematic perspective view showing the first terminals and the second terminals of the electrical plug connector of the first embodiment.
Figure 12:
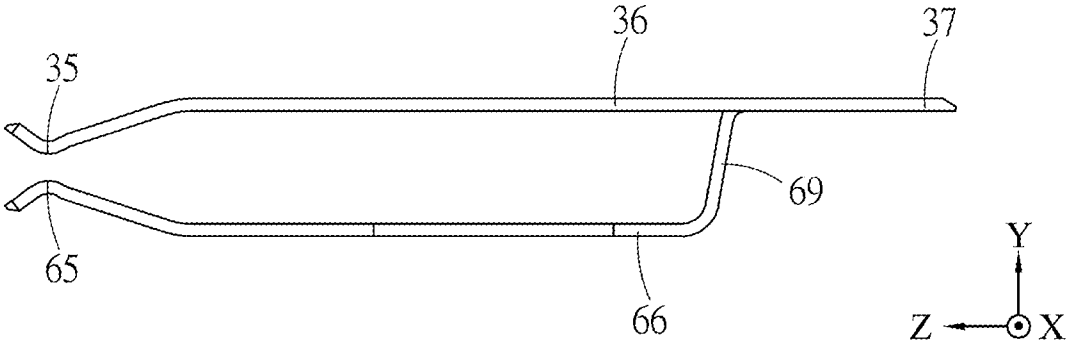
FIG. 12 illustrates a schematic side view of FIG. 10.

Please refer to FIGS. 3, 8, 10, and 12. FIG. 8 illustrates a rear plan view of the electrical plug connector 100 of the first embodiment. FIG. 10 illustrates a schematic perspective view showing the first terminals and the second terminals of the electrical plug connector of the first embodiment. FIG. 12 illustrates a schematic side view of FIG. 10. In some embodiments, the second tail portion 67 of the second ground terminal 63, the second tail portion 67 of the second power terminal 62, and the second tail portions 67 of the second high-speed signal terminals 611 are between a group at one side and having the first tail portion 37 of the first ground terminal 33, the first tail portion 37 of the first power terminal 32, and the first tail portions 37 of the first high-speed signal terminals 311 and a group at the opposite side and having the first tail portion 37 of the first ground terminal 33, the first tail portion 37 of the first function terminal 34, and the first tail portions 37 of the first low-speed signal terminals 312.

Please refer to FIGS. 3, 8, and 10. In some embodiments, a recessed portion 45 is formed on the first assembling block 4, and a protruding portion 75 protrudes from the second assembling block 7. The protruding portion 75 is combined with the recessed portion 45, and the second tail portions 67 extend out of the second assembling block 7 from the side portion of the protruding portion 75. In some embodiments, the second tail portions 67 are parallel to the first tail portions 37, and the second tail portions 67 and the first tail portions 37 are arranged as one row P, but embodiments not limited thereto. The first terminals 3 are parallel to each other and do not have bent structure in the Y axis direction, as shown in FIG. 10. The second terminals 6 are bent and have bent structures in the Y axis direction, as shown in FIG. 10. The horizontal position of the second tail portion 67 can be adjusted using the second vertical bent portion 69. Hence, the second tail portions 67 and the first tail portions 37 are arranged parallel, and the second tail portions 67 and the first tail portions 37 can be arranged as one row P, as shown in FIG. 10. In this embodiment, the second tail portions 67 and the first tail portions 37 are at an upper portion of the first assembling block 4, as shown in FIG. 8, but embodiments are not limited thereto.

Figure 9:
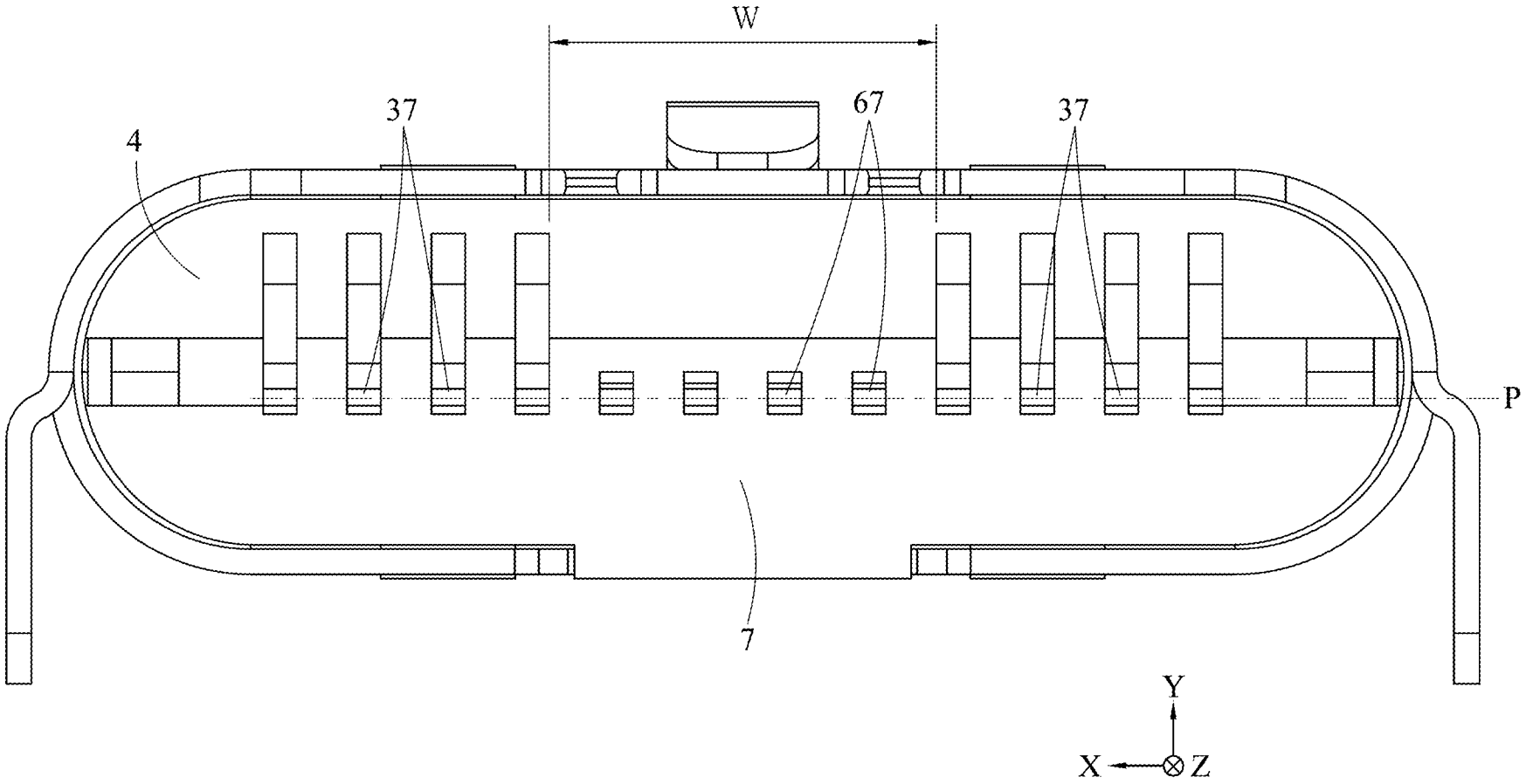
FIG. 9 illustrates a rear plan view of an electrical plug connector according to a second embodiment of the instant disclosure.

Please refer to FIG. 9. FIG. 9 illustrates a rear plan view of an electrical plug connector 100 according to a second embodiment of the instant disclosure. In some embodiments, the second tail portions 67 and the first tail portions 37 are arranged in parallel. In this embodiment, the second tail portions 67 and the first tail portions 37 are at a lower portion of the second assembling block 7, as shown in FIG. 9.

Please refer to FIGS. 3, 8, and 10. In some embodiments, the first terminals 3 comprise a plurality of first horizontal bent portions 38, and the first horizontal bent portions 38 are formed at the first body portion 36 of first function detection terminal 34 and the first body portions 36 of the pair of the first low-speed signal terminals 312. Accordingly, the positions of the first tail portions 37 of the first function detection terminal 34 and the pair of the first low-speed signal terminals 312 can be adjusted, so that the positions of the first tail portions 37 of the first function detection terminal 34 and the pair of the first low-speed signal terminals 312 can be aligned at different horizontal lines.

Please refer to FIGS. 3, 8, and 10. In some embodiments, a spacing width W is kept between the first tail portion 37 of the first ground terminal 33, the first tail portion 37 of the first power terminal 32, and the first tail portions 37 of the first high-speed signal terminals 311 at one side and the first tail portion 37 of the first ground terminal 33, the first tail portion 37 of the first function terminal 34, and the first tail portions 37 of the first low-speed signal terminals 312 at the opposite side. Accordingly, the second tail portions 67 can be aligned in the spacing width W.

Please refer to FIGS. 3, 8, and 10. In some embodiments, the second terminals 6 comprise a plurality of second horizontal bent portions 68 formed at the second body portions 66 of the second terminals 6. The positions of the second flexible contact portions 65 and the positions of the second tail portions 67 can be adjusted using the second horizontal bent portions 68, so that the positions of the second flexible contact portions 65 and the positions of the second tail portions 67 can be aligned at different horizontal lines. Accordingly, the second flexible contact portions 65 are at a bottom right portion of the insertion side of the electrical plug connector 100, as shown in FIG. 7, and the second tail portions 67 are at a middle portion of the soldering side of the electrical plug connector 100, as shown in FIG. 8.

Please refer to FIGS. 3, 8, and 10. In some embodiments, the second terminals 6 comprise a plurality of second vertical bent portions 69, and the second vertical bent portions 69 are formed adjacent to the second tail portions 67, respectively. The positions of the second tail portions 67 can be adjusted using the second vertical bent portions 69, so that the second tail portions 67 and the first tail portions 37 can be arranged parallel and can be aligned at a same row P (as shown in FIG. 10, the row P is aligned in the X axis direction). Accordingly, the tail portions can be attached on the contacts at a same surface of a circuit board (PCB, not shown) for subsequent soldering process.

Figure 11:
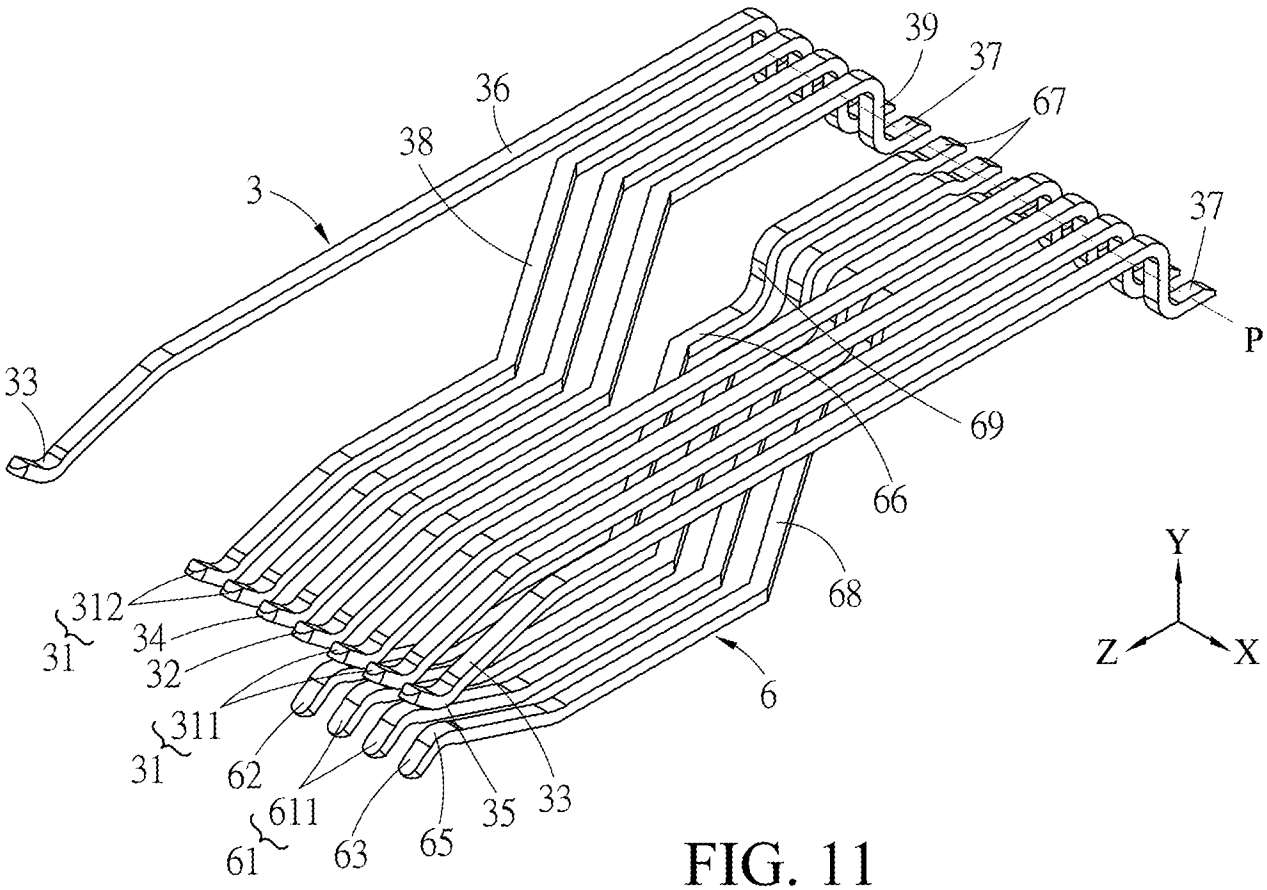
FIG. 11 illustrates a schematic perspective view showing the first terminals and the second terminals of the electrical plug connector of the second embodiment.
Figure 13:
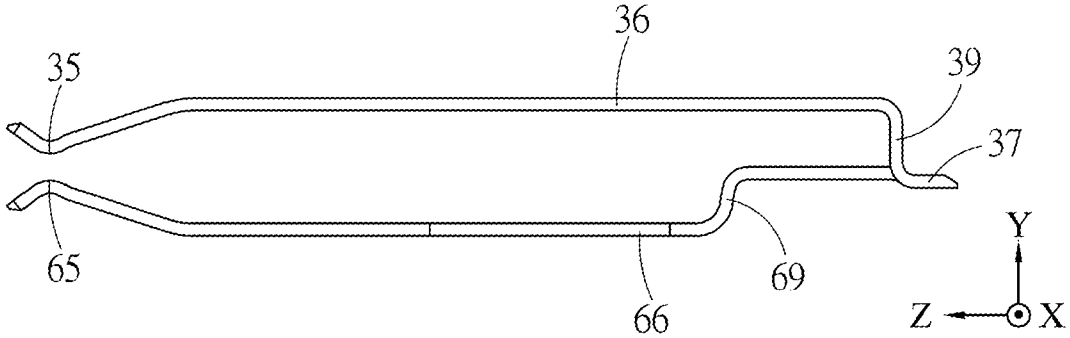
FIG. 13 illustrates a schematic side view of FIG. 11.

Please refer to FIGS. 11 and 13. FIG. 11 illustrates a schematic perspective view showing the first terminals 3 and the second terminals 6 of the electrical plug connector 100 of the second embodiment. FIG. 13 illustrates a schematic side view of FIG. 11. In some embodiments, the first terminals 3 comprise a plurality of first vertical bent portions 39, and the first vertical bent portions 39 are formed adjacent to the first tail portions 37, respectively; moreover, the second terminals 6 comprise a plurality of second vertical bent portions 69, and the second vertical bent portions 69 are formed adjacent to the second tail portions 67, respectively. The positions of the second tail portions 67 and the positions of the first tail portions 37 can be adjusted using the second vertical bent portions 69 and the first vertical bent portions 39, so that the second tail portions 67 and the first tail portions 37 can be arranged parallel and can be aligned at a same row P (as shown in FIG. 11, the row P is aligned in the X axis direction). Accordingly, the tail portions can be attached on the contacts at a same surface of a circuit board (PCB, not shown) for subsequent soldering process.

Figure 14:
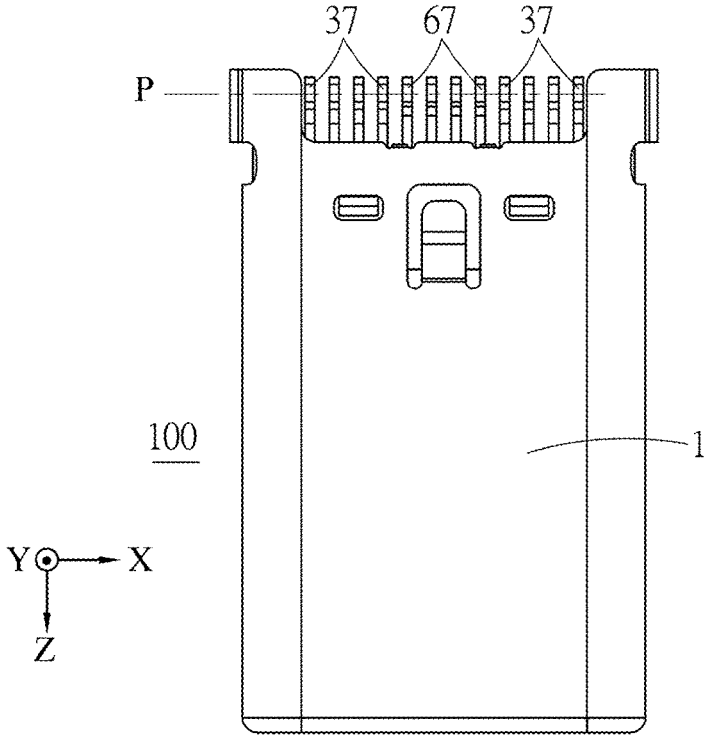
FIG. 14 illustrates a top plan view of the electrical plug connector of the first embodiment.
Figure 15:
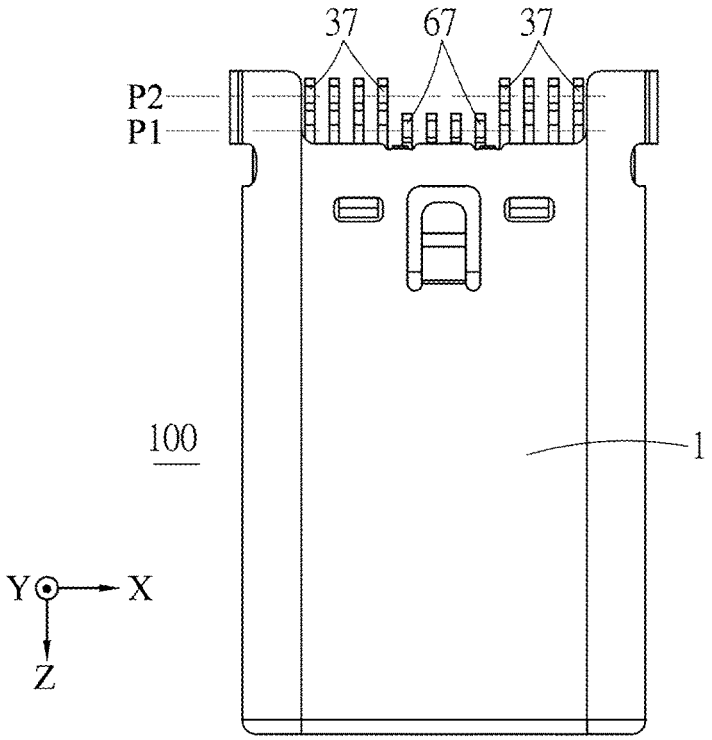
FIG. 15 illustrates a top plan view of an electrical plug connector according to a third embodiment of the instant disclosure.

Please refer to FIG. 14. FIG. 14 illustrates a top plan view of the electrical plug connector 100 of the first embodiment. In FIG. 14, the second tail portions 67 are parallel to the first tail portions 37, and the second tail portions 67 and the first tail portions 37 are arranged as the same row. Please refer to FIG. 15. FIG. 15 illustrates a top plan view of an electrical plug connector 100 according to a third embodiment of the instant disclosure. In FIG. 15, the second tail portions 67 are not parallel to the first tail portions 37, and the second tail portions 67 and the first tail portions 37 are arranged as different rows. Specifically, in this embodiment, the tail portions are arranged into two rows, i.e., a front row P1 and a rear row P2. The second tail portions 67 are arranged in the front row P1, and the first tail portions 37 are arranged in the rear row P2, but embodiments are not limited thereto. In some embodiments, the positions of the second tail portions 67 and the positions of the first tail portions 37 may be exchanged.

Please refer to FIGS. 3 to 6. In some embodiments, more specifically, the first assembling block 4 is formed with the first terminals 3, and the second assembling block 7 is formed with the second terminals 6. In this embodiment, the first assembling block 4 is combined with the first body portions 36 by insert-molding, and then the second assembling block 7 is combined with the second body portions 66 by insert-molding. Next, the first assembling block 4 combined with the first terminals 3 and the second assembling block 7 combined with the second terminals 6 are respectively assembled on the upper portion and the lower portion of a metallic member 9. Thereafter, a semi-product formed by the metallic member 9, the first terminal module 101, and the second terminal module 102 are assembled into the receiving cavity 11 of the metallic shell 1.

Please refer to FIGS. 3 to 6. In some embodiments, two sides of the first insulated housing 2 comprise two first buckling grooves 21, two sides of the first assembling block 4 comprise two first engaging blocks 41, and each of the first engaging blocks 41 is engaged with the corresponding first buckling groove 21. Similarly, in some embodiments, two sides of the second insulated housing 5 comprise two second buckling grooves 51, two sides of the second assembling block 7 comprise two second engaging blocks 71, and each of the second engaging blocks 71 is engaged with the corresponding second buckling groove 51.

Please refer to FIGS. 3 to 6. In some embodiments, an inner side of the first assembling block 4 comprises a first positioning structure 42 (the first positioning structure 42 may be a convex structure (i.e., a post structure) or a concave structure (i.e., a hole structure)), an inner side of the second assembling block 7 comprises a second positioning structure 72 (the second positioning structure 72 may be a convex structure (i.e., a post structure) or a concave structure (i.e., a hole structure)), and the first positioning structure 42 is combined with the second positioning structure 72 (a combination of a convex structure and a concave structure). In this embodiment, the first positioning structure 42 has a cylindrical post, and the second positioning structure 72 has a cylindrical slot so as to be engaged into the cylindrical post.

Please refer to FIGS. 3 to 6. In some embodiments, the electrical plug connector 100 further comprises a metallic member 9, and the metallic member 9 is between the first insulated housing 2 and the second insulated housing 5. In some embodiments, the metallic member 9 is formed by blanking techniques, but embodiments are not limited thereto. In some embodiments, the metallic member 9 may be formed by stamping techniques. A metallic member 9 may be formed by blanking techniques. Moreover, the metallic member 9 further includes two side latches, two side arms 93 of two side latches respectively extend from two sides of the metallic member 9 along the rear-to-front direction. The middle portion of the metallic member 9 is approximately formed as a rectangular plate and has at least one buckling hole 91. The first positioning structure 42 and the second positioning structure 72 are inserted into the corresponding buckling hole 91, so that the metallic member 9 is positioned between the first insulated housing 2 and the second insulated housing 5.

Please refer to FIGS. 3 to 7. In some embodiments, each of the side arms 93 is an elongate latch structure. Moreover, the side arms 93 are symmetrical with each other. The side arms 93 extend outward from two sides of the metallic member 9 in a same direction, respectively, and the side arms 93 are disposed in the two sides of the first insulated housing 2 and the second insulated housing 5 along a transverse direction. The transverse direction is perpendicular to the vertical direction and the longitudinal direction.

Each of the side latches further comprises a latch portion and a leg. Each of the latch portions s at the front portion of the corresponding side arm 93 and is inserted into the insertion cavity 103 along the transverse is at the front portion of the corresponding side arm 93 and is inserted into the insertion cavity 103 along the transverse direction. The latch portions and the side latches are provided for latching and contacting a tongue portion of an electrical receptacle connector. Additionally, the latch portions of the side latches are provided for latching and contacting a mid-plate inside a tongue portion of a USB type-C electrical receptacle connector. The metallic member 9 and the two side latches can be a unitary element or the metallic member 9 and the two side latches can be discrete elements. When the electrical plug connector 100 is mated with an electrical receptacle connector (not shown), the elastic contact portions of the side arms 93 provide a holding function for positioning with the electrical receptacle connector. Moreover, each of the legs extends from the rear portion of the corresponding side arm 93, and the legs protrude out of the first insulated housing 2 and the second insulated housing 5 so as to contact the circuit board.

Please refer to FIGS. 3 to 7. In some embodiments, as shown in FIG. 7, the first flexible contact portions 35 are arranged in a transverse direction to be the first row in the insertion cavity 103 (the upper row shown in FIG. 7), and the second flexible contact portions 65 are arranged in the transverse direction to be the second row in the insertion cavity 103 (the lower row shown in FIG. 7). In the first row, one of the first flexible contact portions 35 is at the left side, and rest of the first flexible contact portions 35 is formed as a first group of the first flexible contact portions 35 and is at the right side. A distance D is between the one first flexible contact portion 35 at the left side and the first group of the first flexible contact portions 35 at the right side. In the second row, the second flexible contact portions 65 are at the right side and respectively correspond to, in a one-to-one manner, some of the first flexible contact portions 35 at the right side.

According to one or some embodiments of the instant disclosure, the first terminal module comprises the first terminals and the first assembling block combined with each other to form a one-piece member by injection molding, and then the first insulated housing is further combined with the first terminal module; likewise, the second terminal module comprises the second terminals and the second assembling block combined with each other to form a one-piece member by injection molding, and then the second insulated housing is further combined with the second terminal module. The four-piece component is assembled into the metallic shell. Accordingly, the number of the components for manufacturing the connector can be reduced, thereby simplifying the assembling procedure for the connector. Moreover, the second tail portions are between the first tail group of the first tail portions and the second tail group of the first tail portions. The second tail portions and the first tail portions are aligned at a same horizontal height and are portions manufactured by surface mount technology (SMT).

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell comprising a receiving cavity;

a first main body comprising a first insulated housing and a plurality of first terminals combined with the first insulated housing, wherein each of the first terminals comprises a first tail portion extending out of an end portion of the first insulated housing, the first tail portions are divided into a first tail group formed by some of the first tail portions and a second tail group formed by the rest of the first tail portions; and a second main body comprising a second insulated housing and a plurality of second terminals combined with the second insulated housing, wherein the first main body and the second main body are combined with each other and received in the receiving cavity, wherein each of the second terminals comprises a second tail portion extending out of an end portion of the second insulated housing, the second tail portions are between the first tail group and the second tail group, the second tail portions and the first tail portions are aligned at a same horizontal height, wherein a pin assignment of the first tail portions of the first terminals, from right to left, is a rightmost first ground terminal, a pair of first high-speed signal terminals, a first power terminal, a first function detection terminal, a pair of first low-speed signal terminals, and a leftmost first ground terminal, wherein an arrangement space for arranging the second tail portions is between the first power terminal and the first function detection terminal.

2. The electrical plug connector according to claim 1, wherein the first terminals comprise a plurality of first horizontal bent portions, the first horizontal bent portions are formed at the first function detection terminal and the pair of the first low-speed signal terminals.

3. The electrical plug connector according to claim 1, wherein a pin assignment of the second tail portions of the second terminals, from right to left, is a second ground terminal, a pair of second high-speed signal terminals, and a second power terminal, wherein the second ground terminal is adjacent to the first power terminal, and the second power terminal is adjacent to the first function detection terminal.

4. The electrical plug connector according to claim 3, wherein the second terminals comprise a plurality of second horizontal bent portions, the second horizontal bent portions are formed at the second ground terminal, the pair of the second high-speed signal terminals, and the second power terminal.

5. The electrical plug connector according to claim 4, wherein the first tail portions and the second tail portions are portions manufactured by surface mount technology (SMT).

6. The electrical plug connector according to claim 3, wherein each of the first terminals comprises a first flexible contact portion arranged at a first row, and each of the second terminals comprises a second flexible contact portion arranged at a second row; from right to left of the second terminals, the second flexible contact portion of the second ground terminal, the second flexible contact portion of each of the pair of the second high-speed signal terminals, and the second flexible contact portion of the second power terminal correspond to, from right to left of the first terminals, the first flexible contact portion of the rightmost first ground terminal, the first flexible contact portion of each of the pair of the first high-speed signal terminals, and the first flexible contact portion of the first power terminal, respectively.

7. The electrical plug connector according to claim 1, wherein the first terminals comprise a plurality of first vertical bent portions, the first vertical bent portions are formed adjacent to the first tail portions, respectively.

8. The electrical plug connector according to claim 1, wherein the second terminals comprise a plurality of second vertical bent portions, the second vertical bent portions are formed adjacent to the second tail portions, respectively.

9. The electrical plug connector according to claim 1, wherein two side latches are respectively disposed on two sides of the first main body and the second main body along a transverse direction, and each of side latches comprises a side arm and a latch portion, wherein the latch portion is at a front portion of the side arm and inserted into an insertion cavity of the electrical plug connector along the transverse direction.

10. An electrical plug connector, comprising:

a metallic shell comprising a receiving cavity;

a first insulated housing comprising a first inner assembling space;

a second insulated housing comprising a second inner assembling space; and a first terminal module which comprises a plurality of first terminals and a first assembling block and a second terminal module which comprises a plurality of second terminals and a second assembling block, wherein the first assembling block is retained in the first inner assembling space of the first insulated housing, and the second assembling block is retained in the second inner assembling space of the second insulated housing, wherein the first insulated housing and the second insulated housing are combined with each other and received in the receiving cavity;

each of the first terminals comprises a first tail portion extending out of an end portion of the first insulated housing, the first tail portions are divided into a first tail group formed by some of the first tail portions and a second tail group formed by the rest of the first tail portions; and each of the second terminals comprises a second tail portion extending out of an end portion of the second insulated housing, the second tail portions are between the first tail group and the second tail group, the second tail portions and the first tail portions are aligned at a same horizontal height.

11. The electrical plug connector according to claim 10, wherein the first assembling block comprises a front portion and a rear portion, the front portion of the first assembling block is retained in the first inner assembling space of the first insulated housing and the rear portion of the first assembling block is behind the first insulated housing.

12. The electrical plug connector according to claim 10, wherein the second assembling block comprises a front portion and a rear portion, the front portion of the second assembling block is retained in the second inner assembling space of the second insulated housing and the rear portion of the second assembling block is behind the second insulated housing.

13. An electrical plug connector, comprising:

a metallic shell comprising a receiving cavity;

a first main body comprising a first insulated housing and a first terminal module which comprises a plurality of first terminals and a first assembling block, wherein the first terminal module is combined with the first insulated housing to form the first main body, each of the first terminals comprises a first tail portion extending out of an end portion of the first insulated housing, the first tail portions are divided into a first tail group formed by some of the first tail portions and a second tail group formed by the rest of the first tail portions; and a second main body comprising a second insulated housing and a second terminal module which comprises a plurality of second terminals and a second assembling block, wherein the second terminal module is combined with the second insulated housing to form the second main body, the first main body and the second main body are combined with each other and received in the receiving cavity, each of the second terminals comprises a second tail portion extending out of an end portion of the second insulated housing, the second tail portions are between the first tail group and the second tail group, the second tail portions and the first tail portions are aligned at a same horizontal height.

14. The electrical plug connector according to claim 13, wherein the first insulated housing comprises a first inner assembling space and the second insulated housing comprises a second inner assembling space, the first assembling block is retained in the first inner assembling space of the first insulated housing, and the second assembling block is retained in the second inner assembling space of the second insulated housing.

15. The electrical plug connector according to claim 13, wherein two side latches are respectively disposed on two sides of the first main body and the second main body along a transverse direction, and each of side latches comprises a side arm and a latch portion, wherein the latch portion is at a front portion of the side arm and inserted into an insertion cavity of the electrical plug connector along the transverse direction.

* * * * *